United States Patent [19]

Griffin et al.

[11] 3,996,639

[45] Dec. 14, 1976

[54] DUST MOP WITH PEEL-OFF MOP HEAD

[76] Inventors: Dana K. Griffin, 24714 Madison Court, Apt. 296, Farmington, Mich. 48024; John R. Wilson, 3203 E. Bradford Drive, Birmingham, Mich. 48010

[22] Filed: Aug. 28, 1975

[21] Appl. No.: 608,518

[52] U.S. Cl. ..... 15/229 B; 15/231

[51] Int. Cl.[2] ..... A47L 13/255; A47L 13/46

[58] Field of Search ..... 15/147 R, 147 A, 228, 15/229 R, 229 A, 229 AC, 229 AP, 229 B, 229 BC, 229 BP, 230.17, 231–233; 2/DIG. 6; 51/318, 391–393; 24/204 R, DIG. 18

[56] References Cited

UNITED STATES PATENTS

| | | | |
|---|---|---|---|
| 1,983,363 | 12/1934 | Glover | 15/231 |
| 3,295,155 | 1/1967 | Belsky et al. | 15/228 X |
| 3,465,364 | 9/1969 | Edelson | 2/DIG. 6 |
| 3,527,001 | 9/1970 | Kleemeier | 15/230.17 X |
| 3,528,120 | 9/1970 | Lindstrom | 15/228 |
| 3,737,938 | 6/1973 | Saltzstein | 15/147 A |
| 3,778,860 | 12/1973 | Thielen | 15/147 A |
| 3,792,505 | 2/1974 | Saltzstein | 15/231 |
| 3,795,934 | 3/1974 | Moss | 15/229 A |
| 3,921,259 | 11/1975 | Brumlik | 24/204 |

FOREIGN PATENTS OR APPLICATIONS

| | | | |
|---|---|---|---|
| A80;153 | 2/1963 | France | 15/230.17 |
| 6,708,504 | 12/1968 | Netherlands | 15/228 |

*Primary Examiner*—Daniel Blum
*Attorney, Agent, or Firm*—Robert G. Mentag

[57] ABSTRACT

A dust mop provided with a mop head frame which has mounted thereon an attachment bridge for attaching the frame to a mop handle. The dust mop includes a dust mop head on the lower side of the frame which is provided with a fiber cloth backing material on the upper side thereof. A plurality of strips of releasable fastening means are mounted on the bottom side of the mop head frame, for releasably attaching the dust mop head on the lower side of the mop head frame.

8 Claims, 9 Drawing Figures

DUST MOP WITH PEEL-OFF MOP HEAD

SUMMARY OF THE INVENTION

This invention relates generally to the dust mop art, and more particularly, to an improved dust mop having a dust mop head frame provided with releasable fastening means on the lower side thereof for releasably attaching a dust mop head to the frame.

Heretofore, many types of dust mops have been provided, but they all have many inherent disadvantages. For example, the prior art dust mops usually include a handle carrier frame which is mounted in a pocket formed by a flexible cloth material on the top of the dust mop head. The attaching of the handle carrier frame of a prior art dust mop to a dust mop head is time-consuming and must be carried out each time a dust mop head is replaced. The time lost in carrying out the last mentioned operation could be more efficiently used in other ways, as for example, in a dusting operation. Another disadvantage of the aforementioned prior art dust mops is that a dust mop of such type is more costly since the forming of a frame pocket on a mop head comprises a significant part of the labor and material for forming a dust mop head. A further disadvantage of such prior art dust mops is that, if the frame pocket is too big, the frame slides around in the pocket. On the other hand, if the frame pocket is too small, as a result of original manufacture or laundering of the dust mop head, then it is difficult to insert the carrier frame into the frame pocket.

In view of the foregoing, it is an important object of the present invention to provide an improved dust mop structure that overcomes the aforementioned disadvantages of the prior art dust mops.

It is another object of the present invention to provide an improved dust mop structure wherein the dust mop head may be quickly and easily attached to a frame by pressing the dust mop head frame onto the dust mop head, and wherein the dust mop head may be quickly and easily peeled from the dust mop head frame.

It is still another object of the present invention to provide an improved dust mop structure which is simple and compact in construction, light in weight, economical to manufacture and efficient in use.

It is a further object of the present invention to provide an improved dust mop structure that includes a dust mop head frame which includes means for attachment of the frame to a dust mop handle, a dust mop head including a dust mop element on the lower side thereof and a fiber cloth backing material on the upper side thereof, and releasable fastening means releasably attaching said dust mop head frame to said dust mop head. The releasable fastening means is preferably a releasable hook means of the "VELCRO" fastening type means.

Other objects, features and advantages of this invention will be apparent from the following detailed description, appended claims, and the accompanying drawings.

DESCRIPTION OF THE PREFERRED EMBODIMENTS

Figure 1:
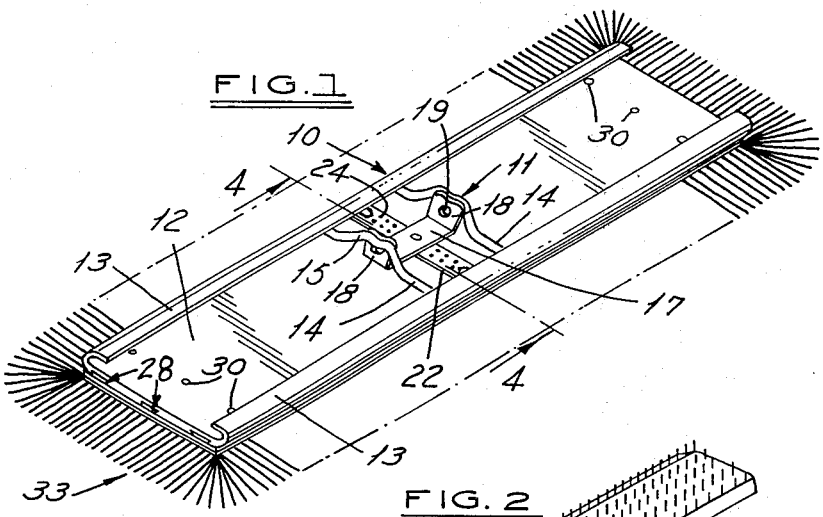
FIG. 1 is a perspective top view of a first embodiment dust mop made in accordance with the principles of the present invention.
Figure 2:
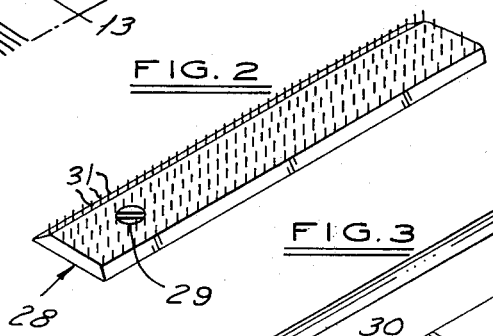
FIG. 2 is a fragmentary, perspective view of a strip of extruded "VELCRO" fastening means employed in the invention.
Figure 3:
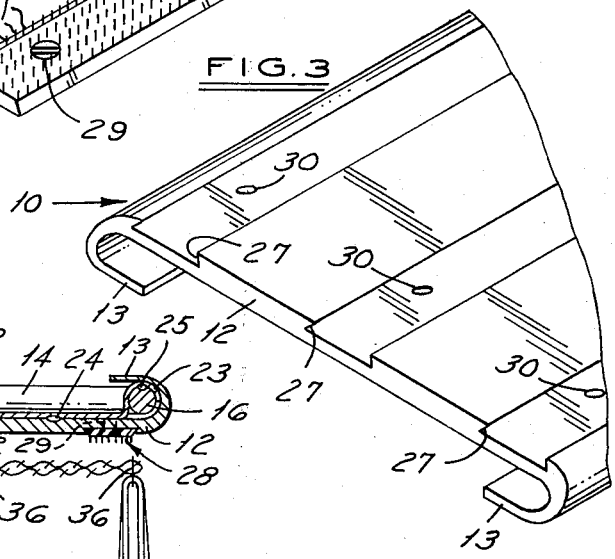
FIG. 3 is a fragmentary, perspective bottom view of the dust frame employed in the dust mop embodiment of FIG. 1.
Figure 4:
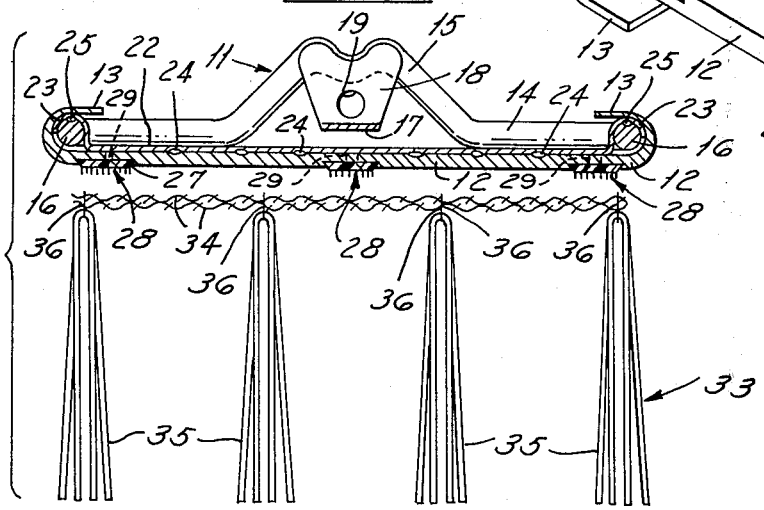
FIG. 4 is an enlarged, elevational section view of the dust mop structure illustrated in FIG. 1, and showing the dust mop head detached from the dust mop frame.

Referring now to the drawings, and in particular to FIGS. 1 through 5, wherein is shown a first illustrative embodiment of the invention, the numeral 10 generally designates a dust mop head frame on which is operatively mounted a conventional dust mop supporting and handle attachment bridge, generally indicated by the numeral 11. As best seen in FIGS. 1 and 3, the dust mop head frame 10 includes an elongated, flat and substantially rectangular main body portion 12 which has integrally formed along each of the two longitudinal edges thereof a C-shaped retainer member 13. The frame 10 may be made from any suitable material, such as aluminum, plastic, wood or the like. The frame 10 shown in FIGS. 1, 3, and 4 illustrates the making of the frame 10 from extruded aluminum.

Figure 5:
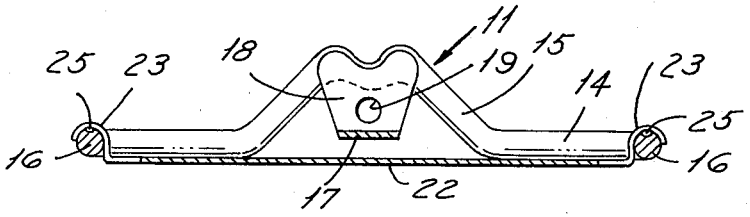
FIG. 5 is a transverse, elevational section view of the handle attachment bracket and attachment strap employed in the dust mop embodiment of FIG. 1.

As illustrated in FIGS. 1, 4 and 5, the dust mop handle attachment bridge 11 includes a pair of transverse rod members 14 which have an upwardly extended, substantially V-shaped portion 15 at the central point thereof. The two transverse bridge rod members 14 are integrally connected at their ends by a pair of longitudinally extended rods 16.

As best seen in FIG. 1, the dust mop handle attachment bridge 11 includes a U-shaped handle attachment member that includes an elongated bight portion 17 and a pair of integral, upwardly extended flange portions 18 which are fixed to the central bridge rod portions 15 by any suitable means, as by welding. The upstanding flanges 18 are provided with pin holes 19 for the reception of conventional retainer pins for mounting the lower end of a mop handle onto the U-shaped handle attachment member.

As shown in FIG. 5, the handle attachment bridge 11 includes an elongated attachment strap 22 which is centrally disposed between the transverse rod members 14, and which has the ends thereof curved or arcuately shaped, as indicated by the numeral 23. As shown in FIG. 5, the attachment strap curved ends 23 are seated over the longitudinal rod portions 16, and are secured thereto by any suitable means, as by being spot welded thereto, as indicated by the numeral 25.

After the attachmemt strap 22 has been secured to the handle attachment bridge 11, the bridge 11 with the attachment strap 22 is then slid into the position shown in FIG. 1, by sliding the same into the ends of the retainer C-shaped flanges 13, and sliding the bridge 11 to a central position as shown in FIG. 1. The bridge 11 is then fixedly secured to the frame 10 by any suitable means, as by spot welding, as indicated by the numeral 24 in FIGS. 1 and 4.

As shown in FIGS. 1, 3 and 4, the dust mop head carrier frame 10 is provided on the lower side of the body portion 12 with a plurality of longitudinally extended dove-tailed slots 27, in each of which is slidably mounted a strip of a suitable releasable fastener means, generally indicated by the numeral 28. The fastener means 28 may be extruded with tapered sides, as shown in FIG. 2, so that the strips of fastening material 28 may be slidably mounted into the grooves 27 from the ends thereof, and secured in place by any suitable means, as by screws 29 threaded into holes 30 in the frame body 12. The releasable fastening means preferably comprises a "VELCRO" type fastening material which is readily available on the market. The fastening means strips 28 are provided with what may be termed a hook portion 31, or the male portion, of a "VELCRO" type fastening material, which is adapted to readily engage and be secured to a female or woven "VELCRO" type fastening material, which is the material that comprises the upper side of the dust mop head 33 and which is indicated by the numeral 34.

The dust mop head 33 is shown in FIGS. 1 and 4, and it comprises a conventional dust mop head including the usual strands of dusting yarn 35. If desired, the yarn 35 may be tufted into a piece of canvas and secured to the fibrous material 34 and secured to the canvas by suitable stitching. The material 34 is the fibrous material that forms the upper face of the mop head 33 for attachment to the releasable fastener means strips 28, and it is made from a suitable woven or non-woven or tufted yarn. This material must be of a nature so that it has fibers which are in a position to catch and hold the "VELCRO" hooks 31 on the lower face of the strips of releasable fastening means 28.

It will be understood that the "VELCRO" type fastening means is a zipper type fastening means which is available on the market from the American Velcro Inc. of Manchester, New Hampshire, and sold under the trademark "VELCRO." It will be understood that other suitable releasable fastening means may be used to releasably fasten the frame 10 to the fibrous material 34 on the upper side of the dust mop head 33.

In use, the dust mop head 33 is laid on a floor with the backing material 34 facing upwardly. The operator then moves the mop handle carrying the frame 10 over the dust mop head 33, and into a position in vertical alignment thereof. The frame 10 is then moved downwardly into fastening engagement with the dust mop head 33, and a downward pressure is exerted so as to engage the "VELCRO" hooks on the fastener strips 28 with the material 34 on the top of the dust mop head 33. The dust mop may be used in the usual way, and when it is necessary to replace the dust mop head 33, the operator grasps one end of the used dust mop head 33 and peels it off from the lower side of the frame 10, whereby a new clean dust mop head 33 may be quickly and easily mounted on the frame 10, in the aforedescribed manner.

It will be understood that the dust mop head 33 may be made from any suitable, washable materials, or from low-cost throwaway materials, so that a dirty dust mop head 33 may be thrown away without the need for cleaning the same.

It will be understood that the "VELCRO" fastening means strips 28 may be mounted as a plurality of transverse strips on the underside of the frame 10. However, it is more advantageous to dispose these strips 28 longitudinally, as shown in FIGS. 1, 3 and 4, so as to eliminate any gaps lengthwise of the dust mop head 33 which would occur with the fastening strips 28 disposed transversely. It is also harder to peel off the dust mop head 33 from the frame 10 when the strips 28 are disposed transversely of the frame body 12.

The structure of the dust mop of the present invention provides an improved dusting action over the surface of a floor because the downward pressure exerted by a mop handle is transferred against the entire dust mop head face, rather than around the frame edges only, as in the prior art dust mops.

Figure 6:
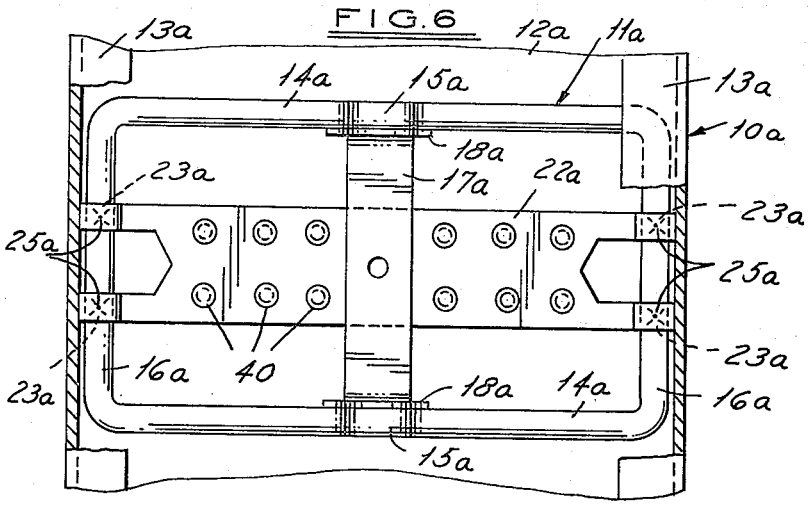
FIG. 6 is a fragmentary, top plan view, with parts broken away, of a second embodiment dust mop made in accordance with the principles of the invention.

FIG. 6 illustrates a second embodiment of the invention, and the parts thereof which are the same as parts in the first embodiment, have been marked with the same reference numerals followed by the small letter *a*. The only difference between the embodiment of FIG. 6 and the first embodiment of FIGS. 1 through 5, is that the attachment strap 22*a* is secured to the body 12*a* of the frame 10*a* by rivets 40, instead of being spot welded. The second embodiment of FIG. 6 operates in the same manner as described hereinbefore for the first embodiment of FIGS. 1 through 5.

Figure 7:
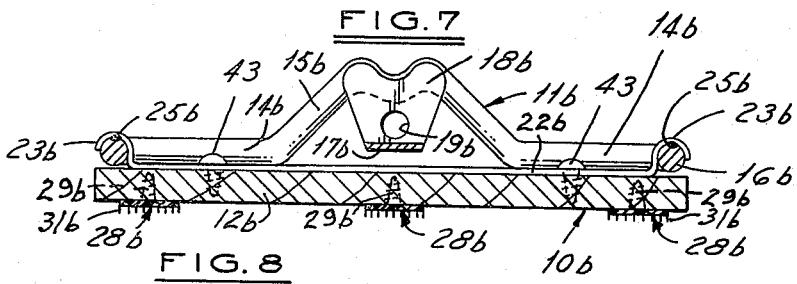
FIG. 7 is an elevational, section view of a third embodiment dust mop made in accordance with the principles of the invention.

FIG. 7 illustrates a third embodiment of the invention, and the parts thereof which are the same as parts in the first embodiment of FIGS. 1 through 5 have been marked with the same reference numbers followed by the small letter *b*. In the embodiment of FIG. 7, the frame 10*b* is made from wood, and the attachment strap 22*b* is secured to the top of the frame body 12*b* by any suitable means, as by a plurality of wood screws 43. A further difference in the embodiment of FIG. 7 is that the elongated releasable fastener strips 28*b* are not recessed, but are fastened on the lower surface of the frame body 12*b* by a plurality of attachment screws 29*b*. The dust mop embodiment of FIG. 7 functions in the same manner as described hereinbefore for the first embodiment of FIGS. 1 through 5.

Figure 8:
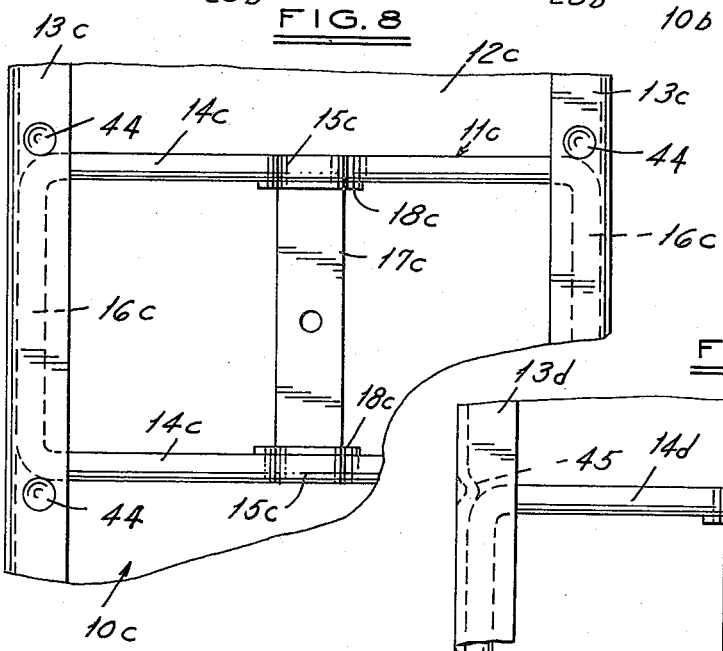
FIG. 8 is a fragmentary plan view of a fourth embodiment dust mop made in accordance with the principles of the invention.

FIG. 8 illustrates a fourth embodiment of the invention, and the parts thereof which are the same as parts of the first embodiment of FIGS. 1 through 5 have been marked with the same reference numerals followed by the small letter *c*. In the embodiment of FIG. 8, the transverse attachment strap has been deleted, and the handle attachment bridge 11*c* is secured in place in the C-shaped retainer flanges 13*c* by being staked in place, as indicated by the staking indentations 44. The bridge 11*c* is provided with a staking indentation 44 at each corner thereof, so as to hold it in place in the C-shaped retainer flanges 13*c*. The embodiment of FIG. 8 functions in the same manner as described hereinbefore for the first embodiment of FIGS. 1 through 5.

Figure 9:
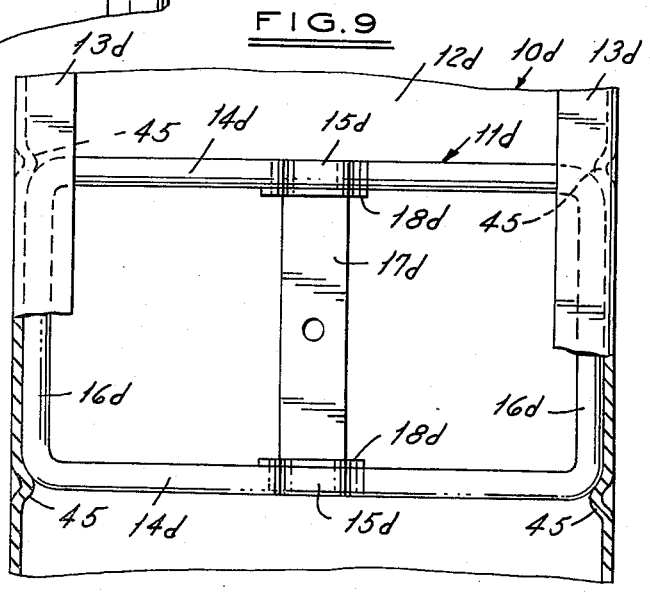
FIG. 9 is a fragmentary top view, with parts broken away, of a fifth embodiment dust mop made in accordance with the principles of the invention.

FIG. 9 illustrates a fifth embodiment of the invention, and the parts thereof which are the same as parts of the first embodiment of FIGS. 1 through 5 have been marked with the same reference numerals followed by the small letter *d*. The handle bridge 11*d* does not include any attachment strap 22, but it is secured in place in the frame 10*d* and in the C-shaped retainer flanges 13*d*, by being staked in place. As shown in FIG. 9, a staking indentation 45 is formed in the bight portion walls of each of the C-shaped retainer flanges 13*d*, at each of the corners of the bridge 11*d*. The embodiment of FIG. 9 functions in the same manner as described hereinbefore for the embodiment of FIGS. 1 through 5.

While it will be apparent that the preferred embodiments of the invention herein disclosed are well calculated to fulfill the objects above stated, it will be appreciated that the invention is susceptible to modification, variation and change.

What is claimed is:

1. In a dust mop having a mop handle, the combination comprising:

a. a dust mop head frame substantially rectangular in plan view and provided along each of the longer edges thereof with opposed inwardly facing C-shaped retainer flanges;

b. means for attachment of the frame to a mop handle including a substantially rectangular attachment bridge having a pair of side rods which are endwise slidably mounted in said C-shaped retainer flanges;

c. means for fixedly securing said attachment bridge to the central portion of said frame;

d. a dust mop head, including a dust mop element on the lower side thereof, and a fiber cloth backing material on the upper side thereof; and e. releasable fastening means on the lower side of said frame for releasably attaching said dust mop head frame to said dust mop head.

2. A dust mop structure as defined in claim 1, wherein:

a. said releasable fastening means comprises a releasable hook means mounted on the lower side of said frame for releasably attaching said frame to said fiber cloth backing material on said dust mop head.

3. A dust mop structure as defined in claim 2, wherein:

a. said releasable fastening means includes a plurality of strip members secured to the lower side of said frame, and wherein said strip members have mounted on the lower side thereof said releasable hook means.

4. A dust mop structure as defined in claim 3, wherein:

a. said releasable fastening means strip members are disposed longitudinally of said frame.

5. A dust mop structure as defined in claim 3, wherein:

a. said releasable fastening means strip members are mounted in mating grooves formed on the lower side of said frame.

6. A dust mop structure as defined in claim 3, wherein:

a. said releasable fastening means strip members are mounted on the lower surface of said frame.

7. A dust mop structure as defined in claim 3, wherein:

a. said means for fixedly securing said attachment bridge to said frame includes staking means.

8. A dust mop structure as defined in claim 3, wherein:

a. said means for fixedly securing said attachment bridge to said frame includes an attachment strap fixed to said bridge, and fixedly secured to said frame.

* * * * *